US007298984B2

(12) United States Patent
Yukutake et al.

(10) Patent No.: US 7,298,984 B2
(45) Date of Patent: Nov. 20, 2007

(54) IMAGE FORMING APPARATUS AND DEVELOPER CONTROL METHOD

(75) Inventors: Takashi Yukutake, Kanagawa (JP); Shuji Tanaka, Kanagawa (JP); Toshikazu Tsumita, Kanagawa (JP); Toshiaki Tsuboi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 227 days.

(21) Appl. No.: 11/268,742

(22) Filed: Nov. 8, 2005

(65) Prior Publication Data

US 2006/0153583 A1 Jul. 13, 2006

(30) Foreign Application Priority Data

Jan. 12, 2005 (JP) ..... 2005-005020

(51) Int. Cl.
*G03G 15/01* (2006.01)
*G03G 15/08* (2006.01)

(52) U.S. Cl. ..... 399/53; 399/223; 399/236

(58) Field of Classification Search ..... 399/53, 399/223, 236, 285, 270
See application file for complete search history.

(56) References Cited

U.S. PATENT DOCUMENTS

2004/0113957 A1* 6/2004 Han

FOREIGN PATENT DOCUMENTS

JP A-2000-206744 7/2000

* cited by examiner

*Primary Examiner*—Susan Lee
(74) *Attorney, Agent, or Firm*—Morgan, Lewis & Bockius LLP

(57) ABSTRACT

An image forming apparatus includes a developer that develops a latent image to form an image, a separation unit that separates image information of a job image by color upon writing a latent image of the job image, a comparison unit that compares the image information by color separated by the separation unit with a threshold value previously set with respect to an image concentration, and a driving condition determination unit that determines a driving condition of the developer using a result of comparison by the comparison unit.

8 Claims, 7 Drawing Sheets

FIG. 7A
| | |
|---|---|
| THRESHOLD VALUE M | CONTINUOUS 8 DOTS |
| THRESHOLD VALUE N | CONTINUOUS 8 DOTS |
| THRESHOLD VALUE X | CONTINUOUS AREA 10 |
FIG. 7B
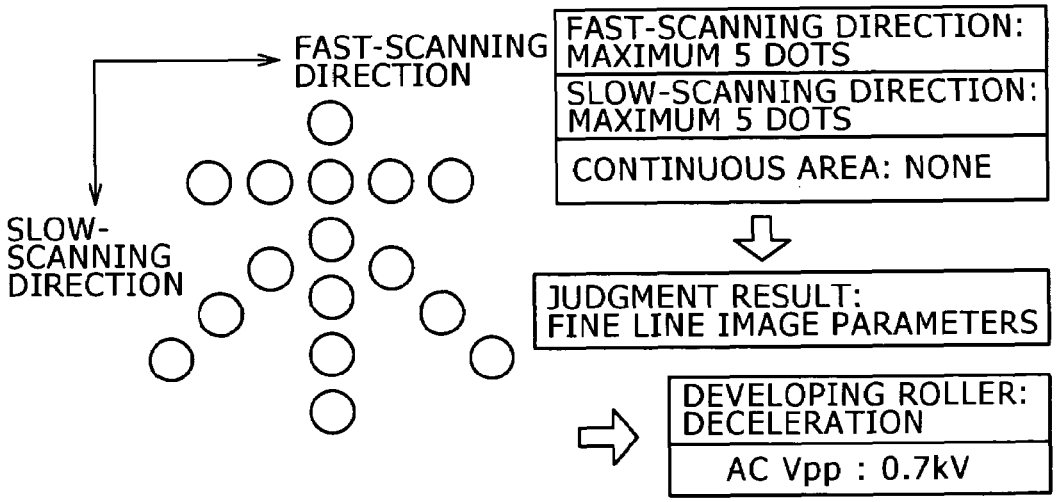
FIG. 7C
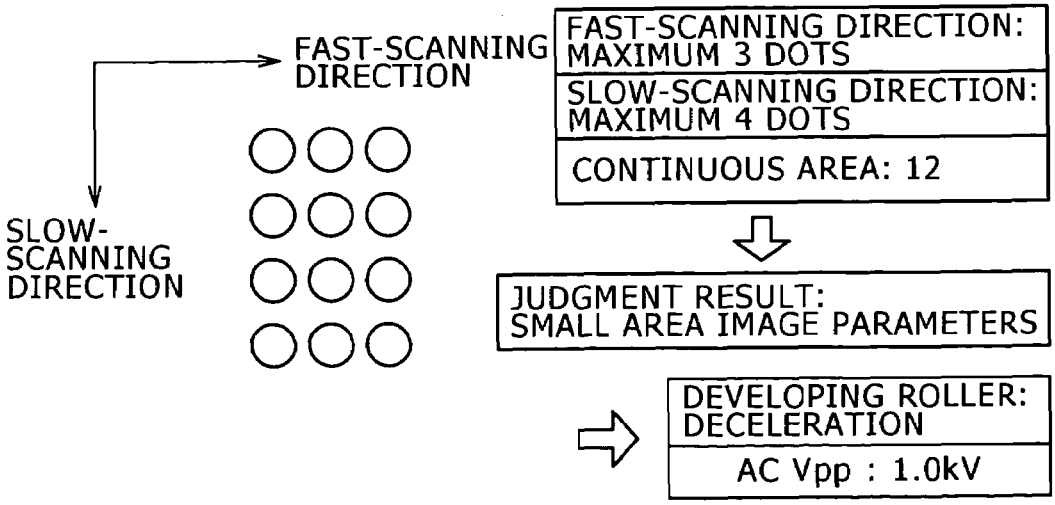

IMAGE FORMING APPARATUS AND DEVELOPER CONTROL METHOD

BACKGROUND OF THE INVENTION

1. Field of the Invention

The present invention relates to an image forming apparatus employed in a copier, a printer and the like, and more particularly, to an image forming apparatus which visualizes an electrostatic latent image with a developer.

2. Description of the Related Art

In image forming apparatuses such as a printer and a copier utilizing an electrophotographic technology, an image forming unit forms an electrostatic latent image by a well-known electrophotographic process on the surface of an image holder having a drum- or belt-type organic photoconductor, and forms a toner image by developing the electrostatic latent image with a developer. Then, the toner image is transferred to a recording sheet directly or via an intermediate transfer medium, and the toner image is heat-fixed to the sheet with, e.g., a fixing device. In this manner, image formation is performed.

On the other hand, in recent years, high quality image formation has been promoted in the image forming apparatuses and image quality in printouts has been further improved. Especially, in on-demand type printing, it is necessary to output a job including various images at a high speed. For this purpose, the image forming unit of the image forming apparatus, especially the developer, is required to keep in an image-formation standby status. When the developer is continuously driven for an image having a low image concentration, toner staying for a long time is stirred with magnetic carrier excessively, thereby a material previously coated on the toner surface changes, and an image quality defect such as transfer failure or fogging occurs. To address these problems, the applicant has proposed a technique for suppressing degradation of a developing material upon occurrence of continuous low-resolution image jobs by forming a toner discharge patch in an inter-image (a portion between images where no image is formed).

As described above, when the developer is continuously driven for a low-concentration image, the low frequency of toner change may degrade the developing material and cause toner pseudo coagulation. Particularly in recent years, the toner diameter is being reduced to improve the graininess in image quality, and the adoption of small-diameter toner having diameters of 6 μm and even 4 to 5 μm is under review. In such small-diameter toner, the space between toner particles is smaller in comparison with large-diameter toner, and the tendency of toner coagulation is extremely high. In a case where the toner particles coagulate in a cluster, a print image, where the toner has been developed, transferred and fixed onto a recording sheet, has a white spot defect. The white spot defect becomes a serious problem in printing of photographic images which particularly requires high image quality.

The technique presented above is resultful to a certain degree. However, as the range of inter-image is narrowed too much in accordance with increased demand for improvement in productivity, it is difficult to ensure a large area for patch image formation in the inter-image. As a result, in some cases, forcible toner discharge cannot be sufficiently performed by using the patch in the inter-image. Further, in a case where a toner patch image is formed on a transfer belt as an application of the technique described above, it may be necessary to provide an upper limit to a discharge image density due to limitation of cleaning of the transfer belt. In such a case, it is conceivable that the function to discharge toner pseudo coagulation in developing is insufficiently performed. Accordingly, a further improved technique is required.

SUMMARY OF THE INVENTION

The present invention has been made in view of the above circumstances and provides an image forming apparatus and a developer control method.

Accordingly, an embodiment of the present invention provides an image forming apparatus including a developer that develops a latent image to form an image, a separation unit that separates image information of a job image by color upon writing a latent image of the job image; a comparison unit that compares the image information by color separated by the separation unit with a threshold value previously set with respect to an image concentration; and a driving condition determination unit that determines a driving condition of the developer using a result of comparison by the comparison unit.

BRIEF DESCRIPTION OF THE DRAWINGS

Embodiments of the invention will be described in detail based on the following figures, wherein:

FIGS. 7A to 7C are tables and explanatory diagrams showing examples of judgment of image information based on threshold values and parameter settings.

DETAILED DESCRIPTION OF THE INVENTION

Hereinafter, an embodiment of the present invention will be described in detail in accordance with the accompanying drawings.

Figure 1:
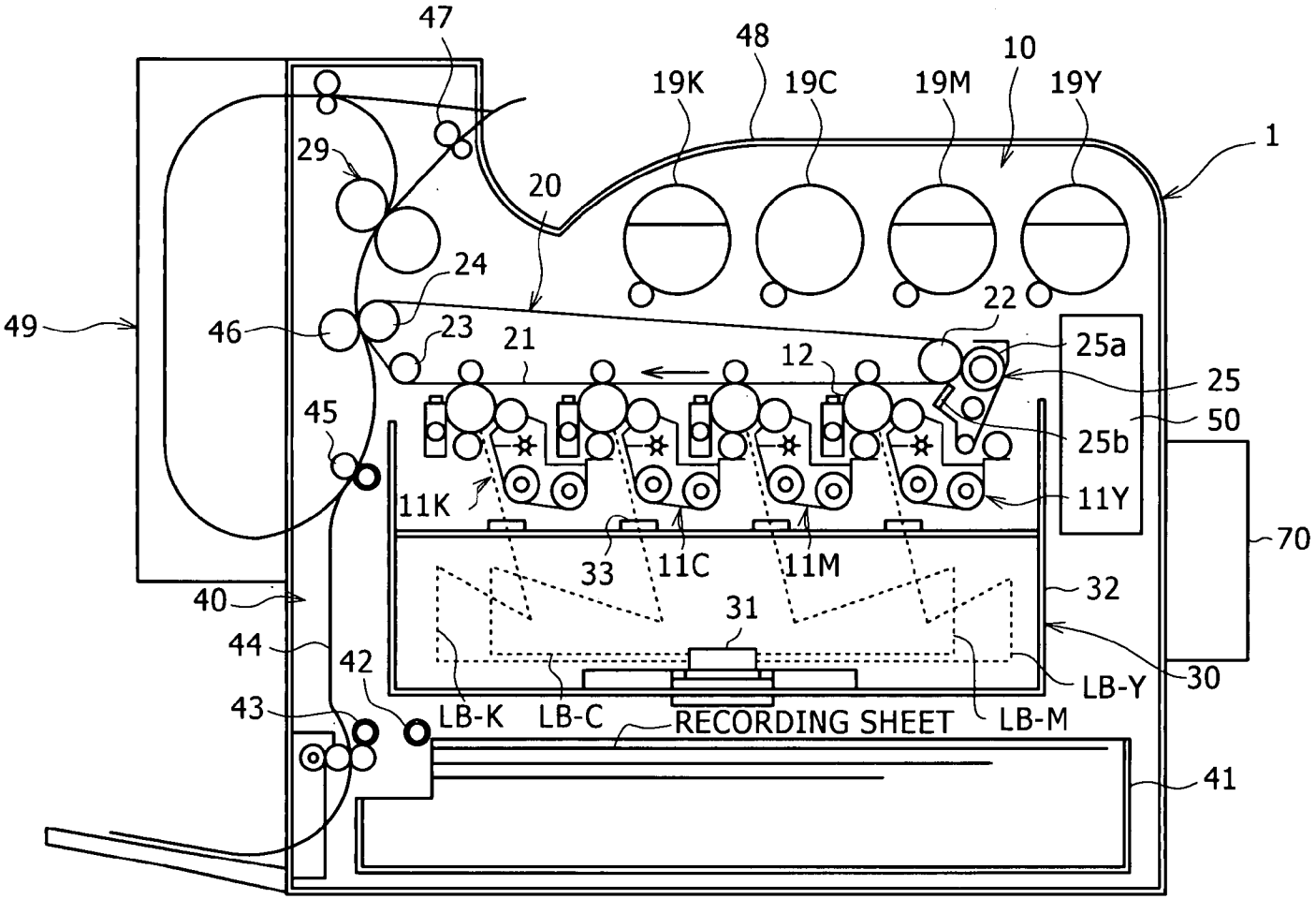
FIG. 1 is a schematic cross-sectional view showing the entire structure of an image forming apparatus according to an embodiment.

FIG. 1 shows the entire structure of an image forming apparatus according to the present embodiment, a so-called tandem-type digital color printer. The image forming apparatus in FIG. 1 has a main body 1 including an image process system 10 to perform image formation in correspondence with respective-color multilevel data, a sheet conveyance system 40 to convey a recording sheet, and a controller 50 to control the entire image forming apparatus. Further, the apparatus has an IPS (Image Processing System) 70 as an image processing system, connected to, e.g., a PC (personal computer) or an image input terminal (IIT), to perform predetermined image processing on image data as a received job image.

The image process system 10 has yellow (Y), magenta (M), cyan (C) and black (K) image forming units 11Y, 11M, 11C and 11K arrayed at predetermined intervals in a horizontal direction. Further, the image process system 10 has a transfer unit 20 to multiple-transfer respective color toner images formed on photoconductor drums 12 of the image forming units 11Y, 11M, 11C and 11K onto an intermediate transfer belt 21, and an ROS (Raster Output Scanner) 30 as an optical system unit to emit laser beam to the image forming units 11Y, 11M, 11C and 11K. Further, the main body 1 has a fixing device 29 to fix an image on a recording sheet, secondary-transferred by the transfer unit 20, to the recording sheet using heat and pressure. Further, the main body 1 has toner cartridges 19Y, 19M, 19C and 19K to supply respective color toner to the image forming units 11Y, 11M, 11C and 11K.

The transfer unit 20 has a drive roller 22 to drive the intermediate transfer belt 21, a tension roller 23 to apply a predetermined tension to the intermediate transfer belt 21, a backup roller 24 to secondary-transfer respective overlaid color toner images onto a recording sheet, and a cleaning device 25 to remove residual toner on the intermediate transfer belt 21. The intermediate transfer belt 21 is placed around the drive roller 22, the tension roller 23 and the backup roller 24 under predetermined tension, and is circulated by the drive roller 22, which is rotate-driven, at a predetermined speed in an arrow direction. The cleaning device 25 has a cleaning brush 25*a* and a cleaning blade 25*b*.

The ROS 30 has a semiconductor laser, a modulator (neither shown), and a polygon mirror 31 to deflect-scan laser beams (LB-Y, LB-M, LB-C and LB-K) emitted from the semiconductor laser. Further, a rectangular-parallelepiped frame 32 to airtightly accommodate the respective constituent elements is provided, and a glass window 33 through which the laser beams (LB-Y, LB-M, LB-C and LB-K) are passed is provided in an upper part of the frame 32, so that the shield effect can be improved.

The sheet conveyance system 40 has a paper feed unit 41 which carries recording sheets and supplies the sheets, a nadger roller 42 to pick up the recording sheet from the paper feed unit 41 and supplies the sheet, a feed roller 43 to separately convey the supplied recording sheets one by one, and a conveyance path 44 to convey the separated recording sheets toward an image transfer unit. Further, the system has a registration roller 45 to convey the recording sheet toward a secondary transfer position at adjusted timing, and a secondary transfer roller 46, provided in the secondary transfer position, to press-contact the backup roller 24 and secondary-transfer an image onto the recording sheet. Further, the system has a discharge roller 47 to discharge the recording sheet, where the toner image has been fixed by the fixing device 29, to the outside of the main body 1, and an exit tray 48 to hold the discharged recording sheet. Further, the system has a double-side conveyance unit 49 to turn over the recording sheet fixed by the fixing device 29 for double side printing.

Next, the image forming units 11Y, 11M, 11C and 11K in the image process system 10 will be described in detail.

Figure 2:
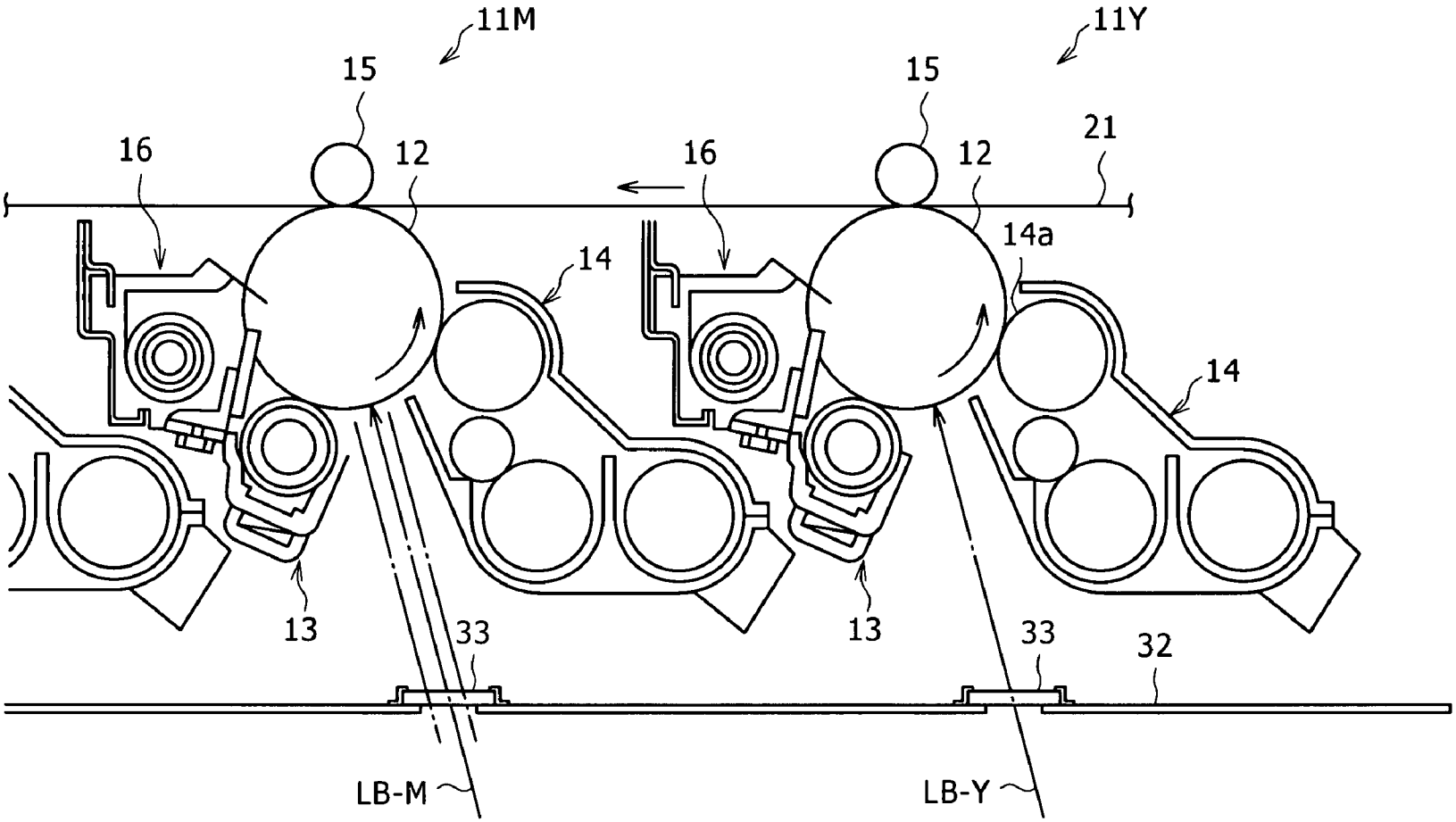
FIG. 2 is a partial expanded cross-sectional view showing the structures of image forming units.

FIG. 2 is a partial expanded view for explanation of the structures of the image forming units 11Y, 11M, 11C and 11K, in which the yellow (Y) image forming unit 11Y and the magenta (M) image forming unit 11M are shown. The other image forming units 11C and 11K have almost the same structure. The image forming units 11Y, 11M, 11C and 11K respectively have the photoconductor drum 12 (12Y, 12M, 12C and 12K) as an image holder to hold a toner image, a charger 13 (13Y, 13M, 13C and 13K) to charge the photoconductor drum 12, a developer 14 (14Y, 14M, 14C and 14K), charged with the charger 13, to develop, with a developing roller 14*a*, an electrostatic latent image formed on the photoconductor 12 with a laser beam (LB-Y, LB-M, LB-C, LB-L) from the ROS 30, a primary transfer roller 15 (15Y, 15M, 15C and 15K), opposite to the photoconductor drum 12, with the intermediate transfer belt 21 therebetween, to transfer the toner image developed on the photoconductor drum 12 onto the intermediate transfer belt 21, and a cleaning device 16 (16Y, 16M, 16C and 16K) to remove residual toner on the photoconductor drum 12 after the transfer. The developer 14 has a stirring member or the like in addition to the developing roller 14*a* as a driving member.

Next, the operation of the image forming apparatus having these constituent elements will be described. Color material image data, formed with an image input terminal (IIT), a PC (both not shown) or the like, is inputted as respectively 8-bit R (red), G (green) and B (blue) reflectance data into the IPS 70. The IPS 70 performs various image processing on the input reflectance data. The processed image data is converted to yellow (Y), magenta (M), cyan (C) and black (K) color material multilevel data, and outputted via the controller 50 to the ROS 30. The ROS 30 exposes the photoconductor drums 12 in correspondence with the input color material multilevel data, thereby forms electrostatic latent images on the photoconductor drums 12. The formed electrostatic latent images are developed with the respective developers 14 (14Y, 14M, 14C and 14K) using respective color toner. The formed toner images are overlay-transferred onto the intermediate transfer belt 21, then secondary-transferred onto a recording sheet conveyed via the sheet conveyance system 40. Then the image is fixed to the recording sheet with the fixing device 29, and is discharged.

Next, the controller 50 to which the present embodiment is applied will be described.

Figure 3:
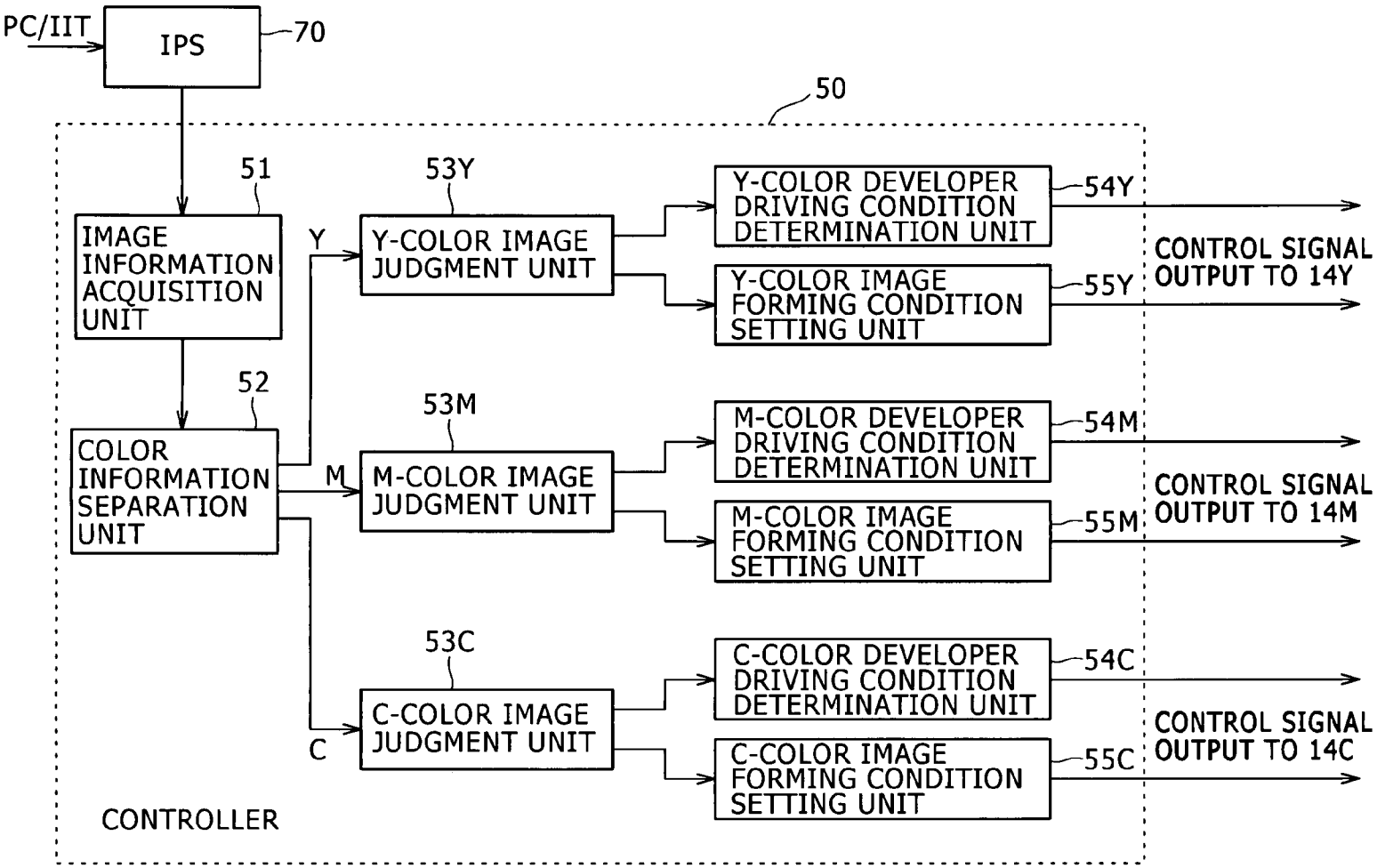
FIG. 3 is a block diagram showing the construction of a controller.

FIG. 3 shows the construction of the controller 50. FIG. 3 shows the control construction for the developers 14 (14Y, 14M and 14C) to develop color toner images. The controller 50 has an image information acquisition unit 51 to acquire image information of an image to be formed from the IPS 70, and a color information separation unit 52 to separate the acquired image information to Y, M, C and K image information and obtain Y, M and C color information. Further, the controller 50 has an image judgment unit 53, a developer driving condition determination unit 54, and an image forming condition setting unit 55, for each color, as a construction to perform control based on the color information separated with the color information separation unit 52. More specifically, the controller 50 has a Y-color image judgment unit 53Y to judge Y-color image concentration, a Y-color developer driving condition determination unit 54Y to determine a developer driving condition such as the speed of the developing roller 14*a* based on the judged image concentration, and a Y-color image forming condition setting unit 55Y to set an image forming condition such as a DC bias and an AC bias based on the judged image concentration. The Y-color developer driving condition determination unit 54Y and the Y-color image forming condition setting unit 55Y output a control signal for the Y-color developer 14Y. Similarly, for M-color processing, the controller 50 has an M-color image judgment unit 53M, an M-color developer driving condition determination unit 54M and an M-color image forming condition setting unit 55M. The M-color developer driving condition determination unit 54M and the M-color image forming condition setting unit 55M output a control signal for the M-color developer 14M. Similarly, for C-color processing, the controller 50 has a C-color image judgment unit 53C, a C-color developer driving condition determination unit 54C and a C-color image forming condition setting unit 55C. The C-color developer driving condition determination unit 54C and the C-color image forming condition setting unit 55C output a control signal for the C-color developer 14C.

In the present embodiment, the image quality of an output image can be excellently maintained while the stress on developing materials included in the developers 14 (14Y, 14M and 14C) to develop color toner images can be reduced, under the control of the controller 50 as shown in FIG. 3. That is, as an index to grasp the stress on the developing materials upon continuous driving of the developers 14, image information of a job image is previously detected. Then, the speed of driving of the developers 14 is reduced (decelerated) for image information having an image panel such as a fine line image or a limited small-area image, thereby the stress on the developing materials can be greatly reduced. Further, as the reduction of the driving speed of the developer 14 is limited to the case of fine line image or limited small-area image, the influence on image quality can be reduced to the minimum, and the image quality of an output image can be excellently maintained.

Next, the relation between the stress on the developing materials and coagulation will be described.

For example, among so-called two-component developing materials separately including toner and carrier, black (K) toner having a particle diameter of 7 to 8 μm and color (Y, M, C) toner having a particle diameter of about 6 μm are popularly used. Since the toner particle diameter has an influence over the graininess in image quality the tendency of reduction of toner particle has been accelerated in recent years in order to improve the quality of a photographic image to the level of a silver chloride photograph. For example, a toner particle diameter of 4 to 5 μm is under review. On the other hand, when the toner particle diameter is reduced, the gap between adjacent toner particles is narrowed and the toner particles are close to each other. As the amount of air existing between the toner particles is reduced, the adjacent toner particles easily coagulate. Although almost no coagulation occurs in black (K) toner having a large toner particle diameter, coagulation frequently occurs in color (Y, M and C) toner having a small toner particle diameter.

Further, in a case where a small company logo is color-printed on a business card, the color developers 14 (14Y 14M and 14C) are continuously driven although the amount of toner consumption is very small. In this case, as the toner staying in the developers 14 for a long time are stirred many times and the release agent previously applied on the surface of the toner is easily changed, the coagulation is promoted. For example, when an image having a low-density color portion is printed by a predetermined amount and then another full-color image is printed, a white spot due to occurrence of toner coagulation easily occur in the printed image. Such a white spot defect becomes a serious problem in printing of photographic images which requires high image quality.

Figure 4:
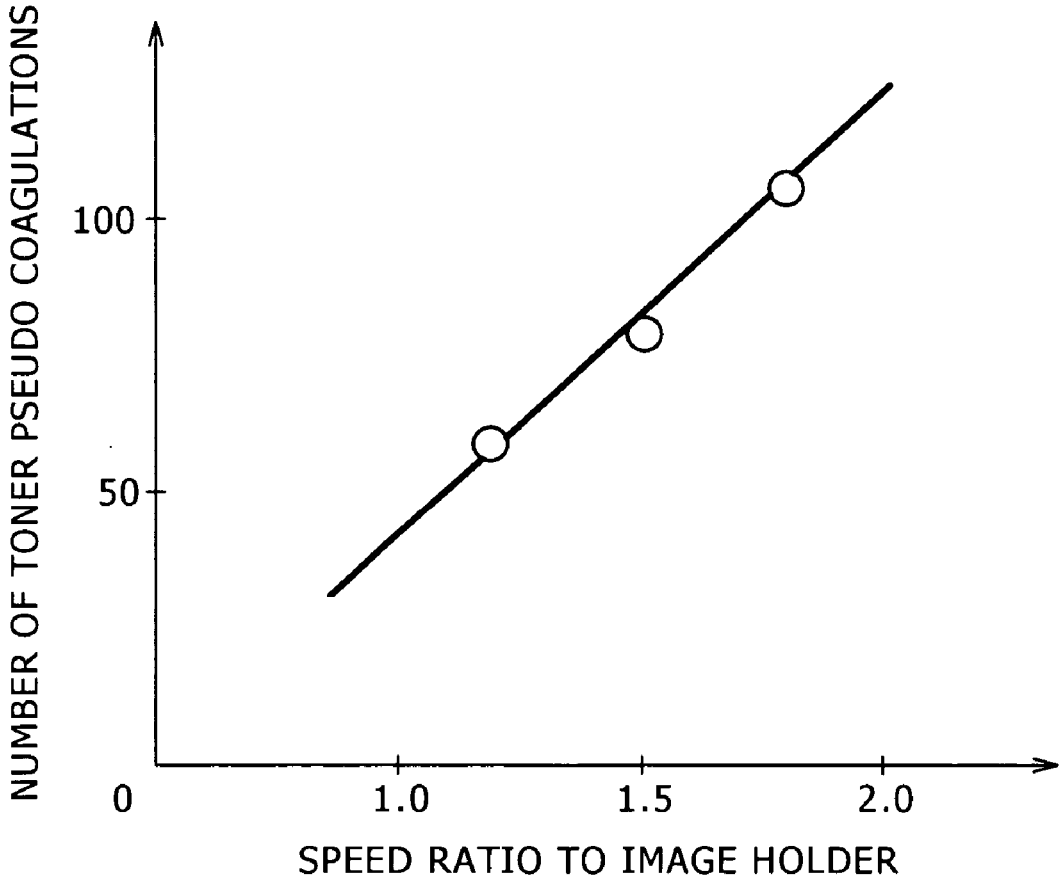
FIG. 4 is a graph showing the relation between a developer driving speed and the amount of generation of toner pseudo coagulation.

FIG. 4 is a graph showing the relation between a driving speed to drive the developer 14 and the amount of generation of toner pseudo coagulation. In FIG. 4, the horizontal axis indicates a speed ratio with respect to the photoconductor drum 12 as an image holder (speed of developing roller 14*a*÷speed of photoconductor drum 12), and the vertical axis indicates the number of toner coagulations. Note that in accordance with reduction of the speed of the developing roller 14*a*, the speeds of respective driving elements such as the stirring member inside the developer 14 are also reduced. However, it is possible to reduce only the speed of the stirring member when the speed of the developing roller 14*a* and that of the stirring member are separately controllable. In this example, printing is performed under a condition that toner is supplied by a total amount of 800 g to the developers 14 and an A3-sized image having a 1% or lower percentage of color portion is outputted, and the number of toner coagulations indicated with the vertical axis is counted when 5000 printouts have been obtained. Under the same stress condition, when the speed ratio with respect to the photoconductor drum 12 is 1.8 which is close to a normal condition, when the speed ratio with respect to the photoconductor drum 12 is 1.5 which is slightly lower than the normal condition, and when the speed ratio with respect to the photoconductor drum 12 is 1.2 which is lower than the normal condition, the number of toner coagulations is counted. In the relation between the photoconductor drum 12 and the developer 14, generally, the speed (circumferential speed) of the developing roller 14*a* is higher than the speed (circumferential speed) of the photoconductor drum 12 because when the both speeds are the same, developing on the photoconductor drum 12 is made by line and developing unevenness is increased. When the speed ratio is 1.8, the number of toner coagulations is over 100. when the speed ratio is 1.5, the number of toner coagulations is about 75. Further, when the speed ratio is reduced to about 1.2, the number of toner coagulations is reduced to about 60. Thus it is shown by experiment that the number of toner coagulations is reduced to about half in comparison with the normal condition.

Accordingly, in the present embodiment, the number of toner coagulations is reduced and the occurrence of image quality defect upon print output is suppressed by changing the driving condition for the developer 14 in correspondence with the image concentration of an image to be printed.

Figure 5:
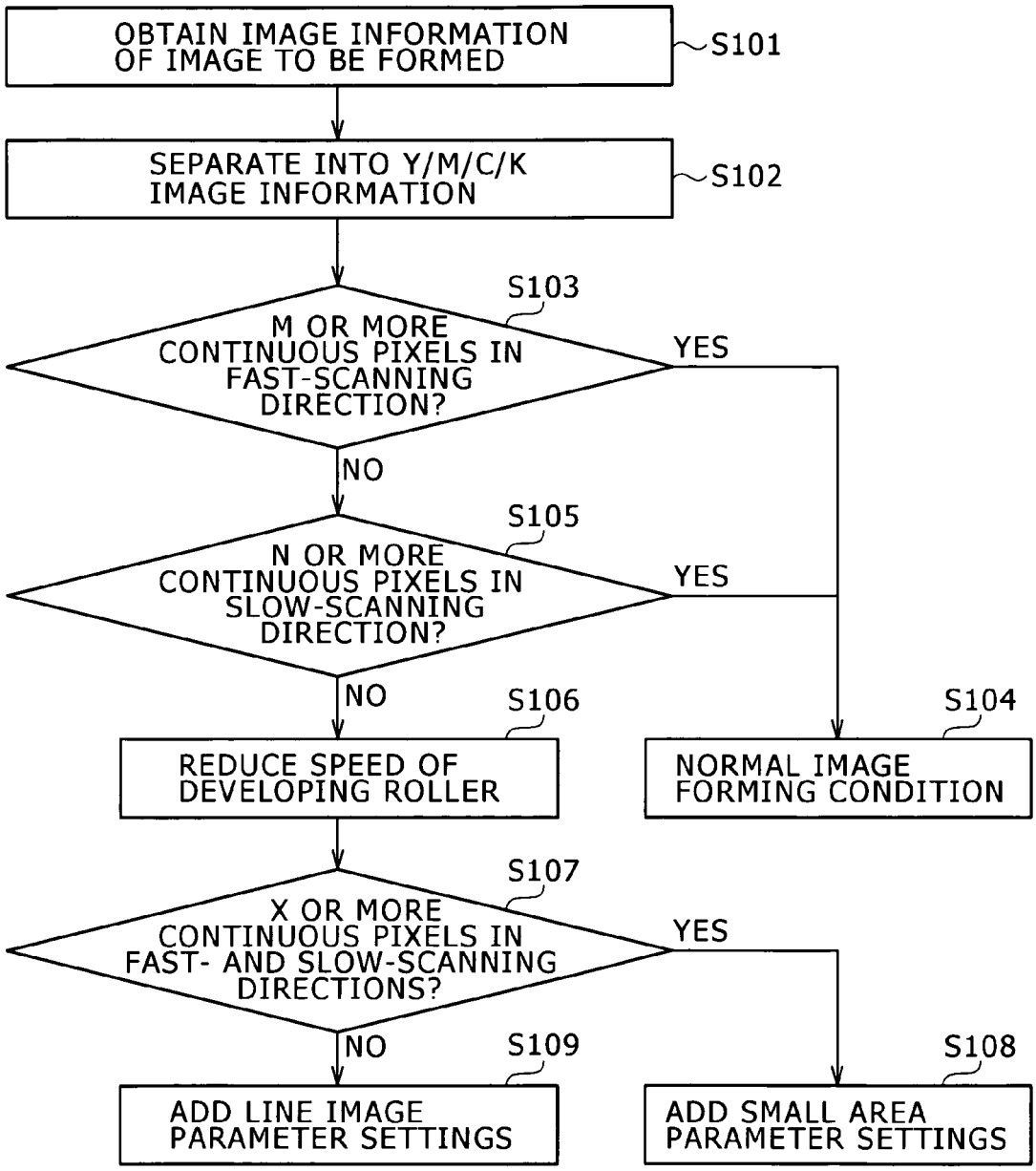
FIG. 5 is a flowchart showing processing performed by the controller in FIG. 3.

FIG. 5 is a flowchart showing processing performed by the controller 50 in FIG. 3. First, the image information acquisition unit 51 in the controller 50 acquires image information of a job image to be printed from the IPS 70 (step S101). Then, the color information separation unit 52 separates the acquired image information into Y, M, C and K image information, and obtains image information of the respective colors (step S102). The separated image information is outputted, in correspondence with the respective colors, to the Y-color image judgment unit 53Y, the M-color image judgment unit 53M and the C-color image judgment unit 53C. For example, regarding Y-color, the Y-color image judgment unit 53Y determines whether or not there are M or more continuous pixels in a fast-scanning direction with regard to the Y-color based on a threshold value M (the number of pixels) previously stored in a memory (not shown) (step S103). If there are continuous pixels, as the toner will be consumed by a predetermined amount or more, the Y-color image forming condition setting unit 55Y performs development under a normal image forming condition (step S104). If there are no continuous pixels, it is determined whether or not there are N or more continuous pixels in a slow-scanning direction based on a threshold value N (the number of pixels) previously stored in the memory (not shown) (step S105). If there are continuous pixels, on the assumption that the toner will be consumed by a predetermined amount or more, the Y-color image forming condition setting unit 55Y performs development under the general image forming condition (step S104). If there are no continuous pixels the Y-color developer driving condition determination unit 54Y performs processing to reduce the speed of the developing roller to prevent toner coagulation (step S106).

Next, the relation between the respective control parameters for the developer 14 and the density will be described.

Figure 6:
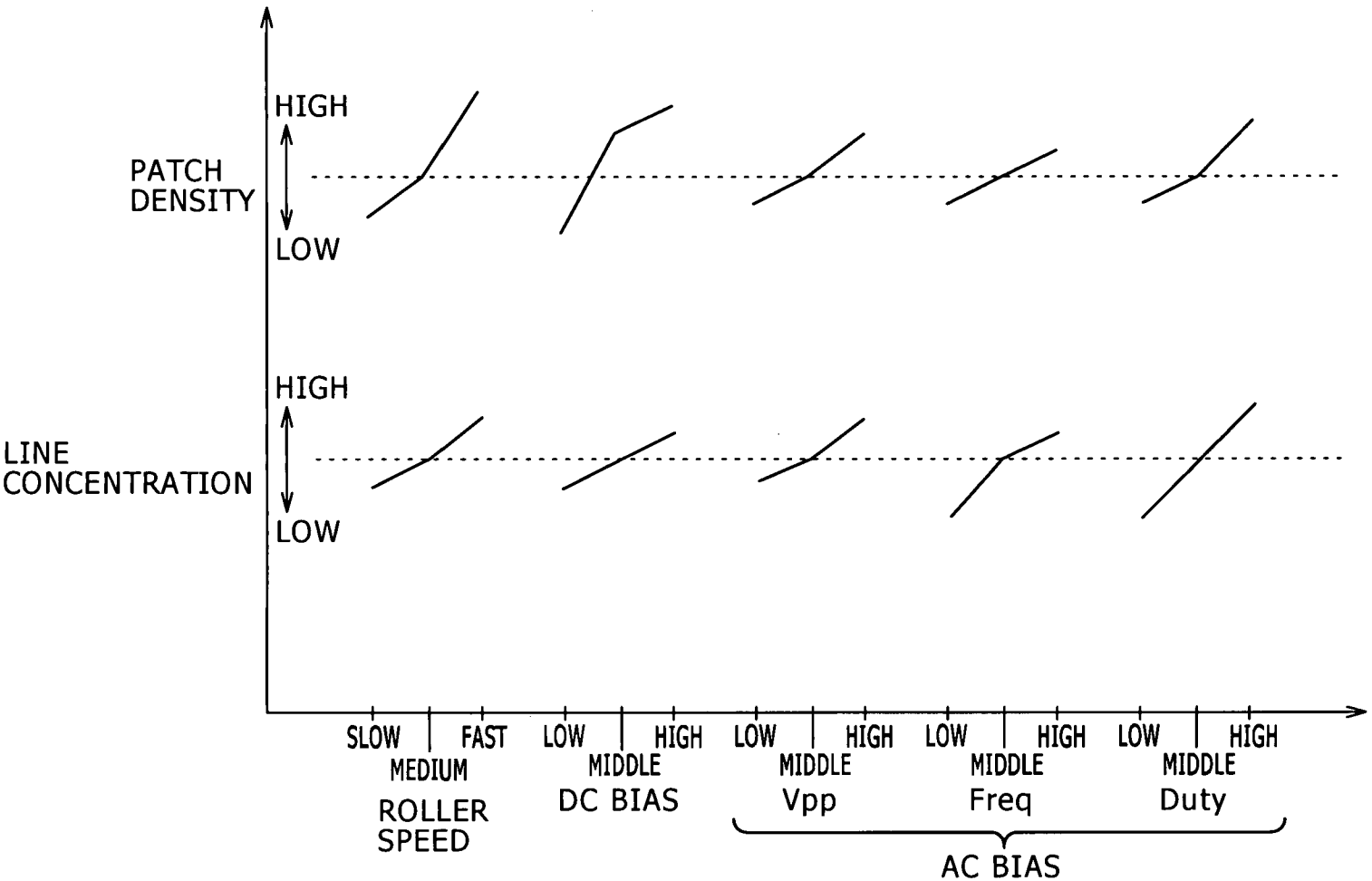
FIG. 6 is a graph showing the influence on area/line concentration by change of the developer driving speed and the influence on the area/line concentration by change of supplemental parameters.

FIG. 6 shows the influence on area/line concentration by change of the developer driving speed and the influence on the area/line concentration by change of supplemental parameters. In FIG. 6, the horizontal axis indicates low/middle/high roller speeds as the driving condition for the developer 14, and low/middle/high control parameter values for the developer 14. As the respective parameters, a voltage peak to peak (Vpp), a frequency (Freq), and a duty ratio (Duty) as an on/off ratio are indicated as the AC bias in addition to the DC bias. The vertical axis qualitatively indicates change rate examples of patch density and line concentration. As in the case of step S106 in FIG. 5, when the roller speed is reduced for prevention of toner coagulation, the patch density and the line concentration are lowered as shown in FIG. 6. Accordingly, as shown in FIG. 6, when the roller speed is reduced, the other various control parameters (DC bias/Vpp/Freq/Duty) may be controlled so as to increase the lowered density to maintain the image quality.

Accordingly, with the control at step S106 to reduce the speed of the developing roller, the Y-color image judgment unit 53Y in the controller 50 determines whether or not there are X or more continuous pixels in the fast-scanning direction and the slow-scanning direction based on a threshold value X previously stored in the memory (not shown) (step S107). If there are continuous pixels, the Y-color image forming condition setting unit 55Y adds parameter settings for a small area to be described later (step S108). If there are no continuous pixels, the Y-color image forming condition setting unit 55Y adds parameter settings for a line image to be described later (step S109).

The above processing is similarly performed regarding the M-color and the C-color.

FIGS. 7A to 7C show examples of judgment of image information based on the threshold values at steps S103, S105 and S107 and parameter settings. FIG. 7A shows an example of the threshold values M, N and X stored in the memory (not shown). FIG. 7B shows an example of the settings of line image parameters at step S109, and FIG. 7C shows an example of the settings of small area parameters at step S108.

In FIG. 7A, "8" for the value of the threshold value M as continuous pixels (the number of dots) in the fast-scanning direction, "8" for the value of the threshold value N as continuous pixels (the number of dots) in the slow-scanning direction, and "10" for the value of the threshold value X as continuous area, are stored in the memory such as a ROM or a DRAM in the controller 50.

In FIG. 7B, the maximum number of continuous pixels in the fast-scanning direction is 5 dots, that in the slow-scanning direction is 5 dots, and there are no continuous areas. Accordingly, the result of judgment is "fine line image parameters". As the number of continuous pixels in the fast-scanning direction and that in the slow-scanning direction are less than the threshold values M and N, the developing roller 14*a* is decelerated. Further, the "fine line image parameters" are adopted, and 0.7 kV as the parameter Vpp in FIG. 6 is selected.

On the other hand, in FIG. 7C, the maximum number of continuous pixels in the fast-scanning direction is 3 dots, that in the slow scanning direction is 4 dots, and the continuous area is 12. Accordingly, the result of judgment is "small area image parameters". As the number of continuous pixels in the fast-scanning direction and that in the slow-scanning direction are less than the threshold values M and N, the developing roller 14*a* is decelerated. Further, as the continuous area is greater than the threshold value X, "10", the "small area image parameters" are adopted, and 1.0 kV as the parameter Vpp in FIG. 6 is selected.

As described in detail above, in the present embodiment, first, the stressed status of the developing material is determined by color. Then, in correspondence with the determined stressed status, the driving speed of the driving member typified by the developing roller 14*a* is reduced in the developer 14 (14Y, 14M and 14C) by color. In this arrangement, the degradation of developing material can be reduced, and the occurrence of toner coagulation can be suppressed. Further, with the reduction of deriving speed, the image forming condition regarding the DC component and the AC component of the developing bias is set. In this arrangement, the phenomenon that the patch density and the line concentration are reduced in accordance with the reduction of the speed of the developing roller 14*a* can be mitigated by setting the image forming condition. Thus excellent image quality can be maintained in a state where the occurrence of image quality defect can be suppressed.

Note that in the present embodiment, as the threshold values for judgment of the respective elements, respectively-single M, N and X values are adopted, however, it may be arranged such that plural threshold values are provided by each judgment. In a case where multi-level image densities are determined in correspondence with the plural threshold values and multi-level driving conditions and image forming conditions are determined, finer control can be realized.

According to the embodiment of the invention, there is provided an image forming apparatus including a developer that develops a latent image to form an image, a separation unit that separates image information of a job image by color upon writing a latent image of the job image; a comparison unit that compares the image information by color separated by the separation unit with a threshold value previously set with respect to an image concentration; and a driving condition determination unit that determines a driving condition of the developer using a result of comparison by the comparison unit.

Note that the threshold value may be a value pertaining to continuous pixels in at least one of a fast-scanning direction and a slow-scanning direction, and when the comparison unit determines that the image information by color is lower than the threshold value, the driving condition determination unit may reduce a speed of a driving member of the developer. As the driving member, a developing roller, a stirring member inside the developer and the like can be used.

Further, when the apparatus further includes an image forming condition setting unit that sets a condition for image formation by the developer using the result of comparison by the comparison unit, the degradation of patch density and line density due to reduction of the speed of the driving member may be reduced. At this time, the threshold value may be a value pertaining to an area of continuous pixels in the fast-scanning direction and the slow-scanning direction. Further, the image forming condition setting unit may set an image forming condition pertaining to at least one of a DC component of a developing bias and an AC component of the developing bias.

On the other hand, the present invention provides a developer control method used in an image forming apparatus, including: obtaining image information of a job image upon writing of a latent image of the job image; separating the obtained image information by color; comparing by color the image information separated by color with a threshold value previously set with respect to an image concentration and stored in a memory; and controlling by color a driving speed of a driving member of the developer based on a result of comparison.

In a case where the driving speed of the driving member is reduced when the image information by color is lower than the threshold value, the stress on the developing material may be reduced. Further, when the control method further includes controlling an image forming condition by the developer based on the result of comparison, the image quality may be maintained.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-005020 filed on Jan. 12, 2005 including specification, claims, drawings and abstract is incorporated herein by reference in its entirety.

What is claimed is:

1. An image forming apparatus, comprising:

a developer that develops a latent image to form an image, a separation unit that separates image information of a job image by color upon writing a latent image of the job image;

a comparison unit that compares the image information by color separated by the separation unit with a threshold value previously set with respect to an image concentration; and a driving condition determination unit that determines a driving condition of the developer using the result of comparison by the comparison unit.

2. The image forming apparatus according to claim 1, wherein the threshold value is a value pertaining to continuous pixels in at least one of a fast-scanning direction and a slow-scanning direction, and the driving condition determination unit reduces a speed of a driving member of the developer when the comparison unit determines that the image information by color is lower than the threshold value.

3. The image forming apparatus according to claim 1, further comprising an image forming condition setting unit that sets a condition for image formation by the developer using the result of comparison by the comparison unit.

4. The image forming apparatus according to claim 3, wherein the threshold value is a value pertaining to an area of continuous pixels in a fast-scanning direction and a slow-scanning direction.

5. The image forming apparatus according to claim 3, wherein the image forming condition setting unit sets an image forming condition pertaining to at least one of a DC component of a developing bias and an AC component of the developing bias.

6. A developer control method comprising:

obtaining image information of a job image upon writing a latent image of the job image;

separating the obtained image information by color;

comparing the separated image information with a threshold value by color, the threshold value previously set with respect to an image concentration and stored in a memory; and controlling by color a driving speed of a driving member of the developer based on a result of comparison.

7. The developer control method according to claim 6, wherein the driving speed of the driving member is reduced when the image information by color is lower than the threshold value.

8. The developer control method according to claim 6, further comprising controlling an image forming condition by the developer based on the result of comparison.

* * * * *